US006755177B2

(12) United States Patent
Woolford et al.

(10) Patent No.: US 6,755,177 B2
(45) Date of Patent: Jun. 29, 2004

(54) SPEED LIMITER

(75) Inventors: Richard Albert Woolford, Connolly (AU); David Richard Worth, Shenton Park (AU); Mark John Taylor, Inglewood (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 120 days.

(21) Appl. No.: 10/110,234

(22) PCT Filed: Dec. 22, 2000

(86) PCT No.: PCT/AU00/01587

§ 371 (c)(1),
(2), (4) Date: Apr. 23, 2002

(87) PCT Pub. No.: WO01/48362

PCT Pub. Date: Jul. 5, 2001

(65) Prior Publication Data

US 2002/0152987 A1 Oct. 24, 2002

(30) Foreign Application Priority Data

Dec. 24, 1999 (AU) ..... PQ4899

(51) Int. Cl.[7] ..... F02D 41/30
(52) U.S. Cl. ..... 123/333; 123/352
(58) Field of Search ..... 123/332, 333, 123/351, 352, 531, 492, 493, 436; 701/104, 105, 110

(56) References Cited

U.S. PATENT DOCUMENTS 4,169,444 A * 10/1979 Kaibara et al. ..... 123/502
4,375,207 A * 3/1983 Sieber et al. ..... 123/333
4,422,420 A * 12/1983 Cromas et al. ..... 123/352
4,474,155 A * 10/1984 Sagues ..... 123/352
4,488,525 A 12/1984 Tsutsumi et al. ..... 123/352
4,940,034 A * 7/1990 Heim et al. ..... 123/497
5,003,769 A * 4/1991 Cantwell ..... 60/39.281
5,715,793 A 2/1998 Motose ..... 123/417
5,970,951 A 10/1999 Ito ..... 123/335
6,505,583 B2 * 1/2003 Matsuda et al. ..... 127/73 C
6,578,555 B2 * 6/2003 Sykes ..... 123/479
2002/0112694 A1 * 8/2002 Kanno et al. ..... 123/319
2002/0115357 A1 * 8/2002 Hiki et al. ..... 440/1
2003/0047164 A1 * 3/2003 Jaye ..... 123/352
2003/0129885 A1 * 7/2003 Tanaka ..... 440/1

FOREIGN PATENT DOCUMENTS

JP 3050355 * 3/1991 ..... F02D/29/02

* cited by examiner

*Primary Examiner*—Hai Huynh
(74) *Attorney, Agent, or Firm*—Rothwell, Figg, Ernst & Manbeck, P.C.

(57) ABSTRACT

A method of controlling the engine speed of an internal combustion engine, the method including the steps of determining the engine speed demanded by an operator of the engine and comparing this demanded engine speed with a predetermined engine speed limit, wherein if the demanded engine speed exceeds the predetermined engine speed limit, the fuelling rate demanded of the operator is only reduced in order to control the engine speed to the predetermined engine speed limit.

40 Claims, 2 Drawing Sheets

SPEED LIMITER

FIELD OF INVENTION

This invention relates to an improved method for controlling the engine speed of an internal combustion engine, and is particularly, though not exclusively, useful in relation to water vehicles or watercraft and motorcycles or scooters.

BACKGROUND INFORMATION

Internal combustion engines are used in a wide variety of applications, such as in motor vehicles (cars, all terrain vehicles and two-wheeled vehicles) and watercraft including personal watercraft (PWCs) and outboard engines for boats. In many of these applications, it may be important in the operation of the engine to be able to govern or limit the rotational speed of the engine under certain circumstances.

For example, a requirement to limit engine speed may arise in order to protect an engine from damage which could be sustained during overly high speed operation, or to limit the overall speed of the vehicle or craft being powered by the engine. One such reason for limiting the speed of the engine may be to provide or enable a lower engine speed "limp-home" mode of operation in response to certain information returned from a specific engine sensor or in response to a specific device failure. Such speed limiting or governing may also be desirable in instances where the operator of a vehicle or craft is inexperienced or if maximum speed limits are provided for a given situation.

PWCs represent one particular engine application where speed limiting may be desirable so as to control engine speed to a level lower than the normal maximum speed limit or capability of the engine. Such speed limiting may be particularly applicable where children or lesser experienced riders will be operating the PWC and additional safety is of concern. By way of such speed limiting, the rider will be unable to achieve the maximum speed of the engine or craft, this speed being likely to prove dangerous or unmanageable for the young or inexperienced rider. Accordingly, the rider's safety is enhanced by restricting the maximum attainable speed of the engine or craft to one that is within the operational capabilities of the rider.

Such speed limiting may also be desirable for hire or rental organisations who may wish to preserve and prolong the usefulness of the products that they make available to the public by restricting the maximum attainable speed of an engine or craft. In this way, the craft is prevented from repeatedly operating at its upper or maximum limit and hence the longevity of the craft and engine thereof can be enhanced. This may be particularly desirable for engines which do not have a maximum speed control except for the engine's natural maximum limit, leaving the engine particularly susceptible to damage from operation at overly high speeds.

Still further, certain legislative bodies are now regulating for lower maximum speeds in particular waterways and roads in built-up areas. Accordingly, the proliferation of such legislated speed limited zones is a further example of where it may be desirable to be able to limit the engine speed of a vehicle or craft.

In recent times, mechanical devices such as governors have been used, and developments in the electronic control of engines have resulted in a greater ability to govern or limit the speed of internal combustion engines. For example, in one such development, it has been proposed to prevent further increases in rotational speed once the engine has reached a preset limit by skipping combustion events. In such a method, typically, an ignition event is simply not scheduled for a particular engine cylinder, and a corresponding combustion event does not occur. This method however has the disadvantage that fuel is still delivered into the combustion chamber, and typically passes out through the engine exhaust system into the environment unburnt. This is both a significant waste of fuel and harmful to the environment. Additionally, residual unburnt fuel can remain in the combustion chamber and adversely affect the following combustion event by reducing the predictability and certainty with regard to the amount of fuel which will be combusted.

A further issue with certain existing speed governing systems is that the rider or operator is completely "removed from the loop" during the period that the engine is operating under such speed governed conditions. That is, whilst the engine speed is being restricted to a certain predetermined limit, the operator effectively has little to no input in regard to the operation of the engine and a suitable controller determines what the specific engine event timings will be to maintain the speed at the preset level. Such operation may not be desirable in all situations and may have certain issues associated therewith.

For example, if the load on the engine was to increase whilst a speed limited mode was enabled, a typical controller would increase the fuelling rate to the engine in order to maintain the predetermined engine speed. However, this increase in fuelling would result without any regard to the operator. Further, such existing systems typically require the operator to specifically disengage the speed control means or to activate a separate deceleration means in order to regain operator control over the engine and in particular the throttle thereof. Such aspects which result from the driver or operator having the control of the engine removed from their authority hence introduces certain safety issues.

OBJECT OF THE INVENTION

Accordingly, it is an object of the present invention to provide an engine speed control method which at least ameliorates some of the above problems. In particular, it is an object of the present invention to provide an engine speed control method wherein total engine control authority is not necessarily removed from the engine operator.

SUMMARY OF THE INVENTION

With the above object in mind, the present invention provides in one aspect a method of controlling the engine speed of an internal combustion engine, the method including the steps of determining the engine speed demanded by an operator of the engine and comparing this demanded engine speed with a predetermined engine speed limit, wherein if the demanded engine speed exceeds the predetermined engine speed limit, the fuelling rate demanded by the operator is only reduced in order to control the engine speed to the predetermined engine speed limit.

Conveniently, if the demanded engine speed is less than the predetermined engine speed limit, then no change is made to the normal operation of the engine. Accordingly, engine speed limited operation only occurs where the demanded engine speed exceeds the predetermined engine speed limit.

Preferably, where the demanded engine speed exceeds the predetermined engine speed limit, an engine speed control means is adapted to only reduce the amount of fuel demanded by an operator of the engine. Hence, even though the operator may demand a greater fuelling rate than that necessary to achieve the predetermined engine speed limit, during such speed limited operation, the actual fuelling rate to the engine never exceeds that corresponding to the predetermined engine speed limit. In effect, the controller which governs the fuelling rate to the engine functions in a unidirectional manner during speed limited engine operation to only ever reduce the demanded fuelling level.

Conveniently, the method as described above is used to control the engine speed to the predetermined speed limit with the level of reduction of the demanded fuelling rate, or the fuel sought to be delivered to the engine, being based on the demanded engine speed. Preferably, the actual amount of fuel to be delivered to the engine can be determined by considering the difference between the demanded engine speed and the engine speed limit and reducing the demanded or normal fuelling level accordingly. The normal fuelling level is considered to be the amount of fuel that would normally be injected, having regard to various parameters such as engine speed and throttle position, if a speed limit or target engine speed was not set and equates to the demanded engine speed.

Preferably, the amount of reduction to the demanded fuelling rate is directly controlled by the operator. That is, once speed limited operation has been enabled and no increase in engine speed is possible in response to further operation of a throttle means by the operator, such actuation of the throttle means may still serve as an input which assists determination of the reduction to the demanded fuelling rate. Hence, in determining the reduced fuelling level, regard may also be had to the position of the throttle means. Under normal operation, an increased throttle position would result in a greater amount of fuel being delivered into the combustion chamber. Accordingly, once the target speed has been reached, the amount of reduction required to the demanded fuelling rate will typically increase as the throttle position or degree of throttle opening increases. In this way, authority over the engine fuelling rate is not completely removed from the operator as the inputs made thereby via the throttle means are used to control the levels of reduction necessary to the demanded fuelling rate to maintain the predetermined limited engine speed.

In an alternative arrangement, throttle position input may be disregarded and rather than determining the required reduction in the fuelling level, a maximum or set amount of fuel may be delivered once the target speed has been reached. When the demanded engine speed subsequently falls below the target speed, normal fuelling levels may then be adopted.

Where the throttle position is varied by the operator during speed limited operation, the actual air-fuel ratio within the engine cylinders may vary due to increasing or decreasing degrees of throttle opening. That is, with a fixed fuelling level being delivered to the engine, throttle movement by the operator may result in a leaner or richer mixture being present in the engine cylinders. This may in turn have an undesirable effect on combustion stability and/or engine output torque. Accordingly, the timing and/or duration of certain engine events such as ignition and fuel delivery may no longer be ideal under such operating conditions.

In accordance with a further aspect of the present invention, there is provided a method of controlling the engine speed of an internal combustion engine including operating the engine in a speed limited mode in response to a demanded engine speed exceeding a predetermined engine speed limit, wherein modified event timings are used during said speed limited mode, said modified event timings varying from the normal event timings which would otherwise be used at the predetermined engine speed.

Preferably, when operating in said speed limited mode, the actual engine fuelling rate is that necessary to achieve the predetermined engine speed. Normal or a first set of event timings would typically be associated with this predetermined engine speed. The modified or second set of event timings relate to those timings which are preferably used when the air-fuel ratio to the engine varies from what it would typically be at the predetermined engine speed. As alluded to hereinbefore, this variance may be a consequence of the throttle position changing, even though the actual fuelling rate to the engine may remain the same.

Event timings typically relate to those key events during a combustion cycle which trigger the delivery and combustion of fuel for power generation in an engine. Ignition and the start and end of fuel delivery are examples of such key events. In a two-fluid fuel injection system, such events may further comprise separate start and end of air or delivery events (as distinct from start and end of metering or fuelling events).

In this regard, the present Applicant has designed and developed numerous such two-fluid fuel injection systems, one example of which is discussed in the Applicant's U.S. Pat. No. 4,693,224, the contents of which are incorporated herein by reference. The method of operation of such a two-fluid fuel injection system typically involves the delivery of a metered quantity of fuel to each combustion chamber of an engine by way of a compressed gas, generally air, which entrains the fuel and delivers it from a delivery injector nozzle. Typically, a separate fuel metering injector, as shown for example in the Applicant's U.S. Pat. No. RE36768, delivers, or begins to deliver, a metered quantity of fuel into a holding chamber within, or associated with, the delivery injector prior to the opening of the delivery injector to enable direct communication with a combustion chamber. When the delivery injector opens, the pressurised gas, or in a typical embodiment, air, flows through the holding chamber to entrain and deliver the fuel previously metered thereinto to the engine combustion chamber.

In an engine operated in accordance with such a two-fluid fuel injection strategy, there are therefore distinct events in the combustion process, including a fuel delivery event, an air delivery or injection event (as opposed to the bulk air delivery into the combustion chamber which occurs separately), and an ignition event. The engine management system typically required to implement such a strategy includes an electronic control unit which is able to independently control each of the fuel, air, and ignition events to effectively control the operation of the engine on the basis of operator input. As such, separate event timings typically exist for each of start of fuel metering (SOF), end of fuel metering (EOF), start of air injection (SOA), end of air injection (EOA) and ignition (IGN).

Conveniently, modified event timings may be used for at least one of SOF, EOF, SOA, EOA or IGN during the period that the engine is operating in speed limited mode. Such modified event timings are preferably selected so as to provide for an improved level of combustion stability and/or improved engine output torque during the speed limited mode and whilst the operator is varying the throttle position from that typically associated with the predetermined engine speed.

When operating in normal non-speed limited mode, the engine event timings may conveniently be selected from look-up maps which comprise total fuel per cycle (FPC) and engine speed as ordinates. This is typically true of a fuel-led engine control system where total FPC is essentially determined on the basis of throttle position and engine speed.

Preferably, when operating in speed limited mode, the modified engine event timings may be determined on the basis of total FPC and throttle position. Conveniently, total FPC and throttle position may be ordinates for an electronic lookup map or table which is stored in an electronic control unit (ECU) which manages the operation of the engine. Such ECUs are well known in the field of engine management and will not be elaborated on further herein. Alternatively, total FPC and air flow to the engine may be ordinates for the look-up table or map. In this manner, some allowance may also be made for engine operation at different attitudes. The adoption of either of the above alternatives is centred around the concept of replacing or eliminating the engine speed ordinate within the look-up in view of the fact that the engine speed is effectively held steady during the speed limited mode of operation. The event timings for the engine during such operation can hence more appropriately be determined on the basis of total FPC and either of throttle position or air flow (i.e. the new look-up table ordinates).

By providing modified event timings in this manner, the operator is still involved in determining which specific event timings are to be used by the ECU, even though the fuelling rate remains fixed for a given engine load.

BRIEF DESCRIPTION OF THE DRAWINGS

The invention will now be described in relation to a preferred embodiment of the invention, and with particular reference to the accompanying drawings, in which.

DETAILED DESCRIPTION OF THE INVENTION

During normal engine operation, as a driver wishes to increase the speed of their vehicle or craft, they typically increase the degree of throttle opening. An electronic control unit (ECU), having detected the change in throttle position, then typically measures the engine speed. Knowing both the engine speed and the throttle position, the ECU can then determine the Fuel per Cycle (FPC) to be delivered or injected. This is especially true of a fuel-led control system. Conveniently, the FPC can be determined from a simple look-up table. From the FPC value, the ECU is then able to look-up specific timings for various combustion events, which in regard to a dual fluid fuel injection system include SOF, EOF, SOA, EOA and IGN. The timings of these control parameters may conveniently be specified as angles relative to TDC or BDC of a combustion cycle, or as time domain settings. In this manner, the most efficient operation of the engine can be achieved with maximum acceleration and response as required by the driver or operator.

As alluded to hereinbefore, in some circumstances, it may be required to, or desirable, to limit the speed of the vehicle or craft. However, whilst it may be required to limit the top speed, it may be desirable that a level of control still resides with the driver, and that acceleration and efficient operation of the engine is not affected whilst at the limited speed or at speeds below the limit or target speed.

Figure 1:
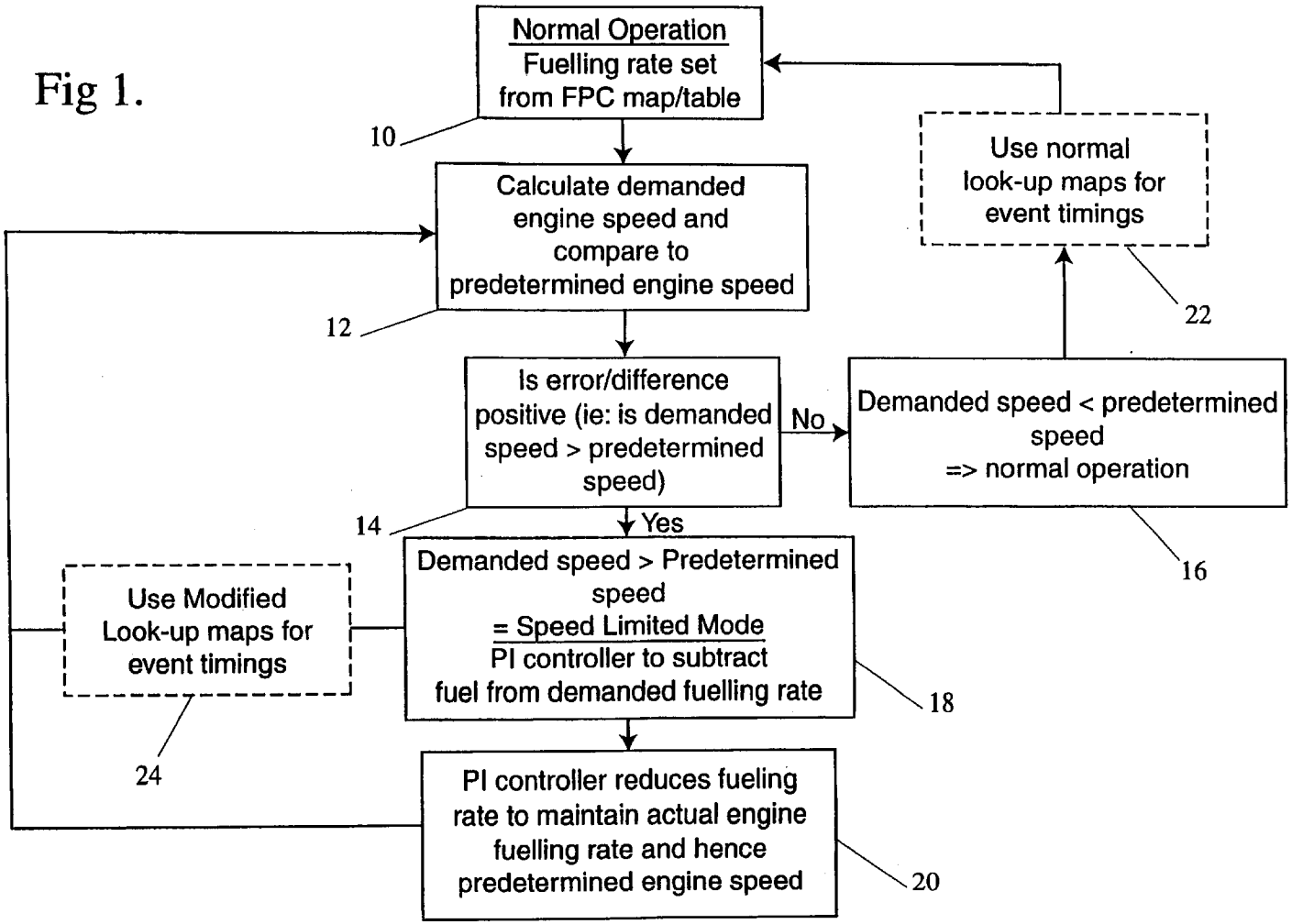
FIG. 1 shows a control diagram of the basic concept of the invention.

Referring now to FIG. 1, the control/flow diagram depicts one embodiment of the present invention where the engine speed may be maintained at a target speed during operation in a speed limited mode. In particular, the method as described enables the operator to maintain some level of authority over the control of the engine.

As seen at 10, the engine is initially functioning under normal operation wherein the fuelling rate to the engine is determined by an FPC look-up map or table, the particular FPC value for a given engine speed being proportional to the throttle position as set by the operator. Accordingly, the throttle position is essentially a measure of driver demand or engine speed. Such an arrangement is typical of a fuel-led control system. Further, in vehicles or crafts that do not have different forward gearings, the throttle position is also essentially a measure of the demanded vehicle or craft speed. Such vehicles and crafts may include personal watercraft (PWCs), outboard engines and scooters among others.

Hence, in such systems, a particular throttle position typically equates to a certain fuelling rate, this being true for a given load which exists on the engine (i.e., as is constituted by the weight of the operator, the conditions within which the craft is being operated etc.). With this in mind, the ECU continually monitors the engine speed demanded by the operator and hence the demanded fuelling rate for the engine. Whilst operating under normal conditions, the actual engine speed follows the demanded engine speed as dictated by the throttle position set by the operator.

At steps 12 and 14, the ECU compares the demanded engine speed with a predetermined or target engine speed to assess whether the operator is demanding an engine speed which exceeds the target engine speed. The target engine speed may be set at any convenient point, but will typically be selected to limit the capability of the operator from operating the vehicle or craft at high engine load. For example, for safety purposes, a lower maximum engine speed and hence a lower craft or vehicle top speed may be desirable for inexperienced or first time users of the vehicle or craft. Alternatively, it may be desirable to limit the maximum engine speed attainable so as to prevent frequent or sustained operation at such speeds which may lead to engine damage or deterioration. This may be particularly applicable in rental situations where the operator is generally not the owner of the vehicle or craft.

The error or difference between the demanded engine speed and the predetermined or target engine speed is calculated so as to determine whether a requirement exists to enter a speed limited mode of operation or not. If the error is not positive (i.e., indicating that the demanded engine speed is less then the predetermined target engine speed) as shown at 16, then normal operation continues with the engine fuelling rate being calculated from the FPC look-up table.

If however the engine speed demanded by the operator exceeds the target speed, that is, a positive error exists as shown at 18, the ECU reverts to a speed limited mode of operation. In this mode of operation, the ECU works to maintain the fuelling rate to the engine at a set level such that the engine speed may be governed to remain at and not exceed the target or predetermined speed. A speed or fuelling controller comprising a proportional integral (PI) or proportional integral differential (PID) system which is managed by the ECU is typically used to adjust the demanded fuelling rate as is required to maintain the target speed.

Since the operator is typically demanding more fuel during this mode of operation to try and increase the engine speed, the ECU and speed controller operate to subtract a quantity of fuel from that demanded by the operator such that a reduced amount of fuel is actually delivered to the engine. This is seen at step 20 in FIG. 1. The demanded fuelling level is determined based on the engine speed and throttle position. The PI controller then calculates the necessary reduction required to the demanded fuel level to maintain the engine speed at the target speed. A resultant amount of fuel is then metered and ultimately delivered into the engine combustion chamber(s).

Thus, once the target speed is reached, the driver or rider will not be able to further increase the engine speed, as the ECU has and will continue to take action to only inject or deliver enough fuel into the combustion chamber(s) so as to maintain the target speed. Attempts by the driver or rider to further increase the engine speed through operation of the throttle will only result in the amount of fuel subtracted from the normal or demanded fuelling level to increase. That is, the rider or operator essentially determines how much fuel is required to be subtracted from the initial demanded fuelling rate and the fuelling controller essentially operates in a uni-directional manner to reduce the demanded fuelling rate accordingly. In this regard, it should be noted that "normal fuelling level" refers to the amount of fuel that would have been delivered if there was no target speed and the engine was not operating in a speed limited mode.

This process of determining a reduced fuelling rate for the engine by virtue of the speed or fuelling controller subtracting an amount of fuel from that demanded by the operator continues until the engine speed demanded by the operator falls below the target speed.

In an alternative arrangement, the ECU may simply assume that the fuelling rate is to remain at a fixed level irrespective of the throttle position. This fixed fuelling rate would then be delivered to the engine until the demanded engine speed falls below the target speed.

Whilst the control diagram of FIG. 1 has been described in relation to engine speed, a similar method may be adapted on the basis of vehicle or craft speed. That is, a target vehicle speed could be set and the ECU could be arranged to maintain this vehicle speed during periods where the operator was demanding a higher vehicle speed. This is particularly true of PWCs, outboard engines and scooters where the engine speed is typically directly proportional to the vehicle speed.

It is evident that by way of the present invention that the driver or rider effectively remains in control of the vehicle or craft at all times, and that whilst they would not be able to increase the engine speed, all other operator controls remain essentially unaffected. For example, the driver would be able to brake or slow the vehicle, simply by reducing the throttle. That is, the fuelling rate to the engine and hence the engine speed is at all times determined by the operator which provides for enhanced safety.

Existing speed governors or cruise control systems typically act to maintain the vehicle at a set speed. If the load on the engine is increased (e.g., going up a hill) then the fuelling rate is increased. Alternatively, if the load on the engine is decreased (e.g., going down a hill) then the fuelling rate is decreased. Under these circumstances, the driver does not remain in effective control at all times, as the speed governor acts to both subtract and add to the prevailing fuelling level. It will be appreciated that under some circumstances the driver may not wish to increase the fuelling rate, and that such increases should only occur when it is safe for the driver. For example, the operator may not want to increase the fuelling level to maintain vehicle speed as the vehicle climbs a short freeway off-ramp.

It is noted that, unlike existing systems, the present method acts to only subtract fuel from the normal or demanded fuelling level. The speed controller does not at any time increase the actual or delivered fuelling level beyond that required to maintain the target speed. Equally, the speed or fuelling controller does not at any time during speed limited operation increase the demanded fuelling rate which is at all times dictated by the operator. This is uncommon for such speed controllers incorporating a PI or PID function which, rather than functioning in a one-way or unidirectional manner, typically operate to both add and subtract fuel to maintain a set engine speed. Further, according to the present method, any decrease in the fuelling level only occurs when the demanded engine speed exceeds the target speed. By this action, the controller does not at any time place the driver or rider in any danger.

The engine speed and hence speed of the vehicle or craft is at all times under the operators control. The driver effectively completes a feedback loop such that the fuelling level can be increased if the engine speed were to drop. If for example the load on the vehicle or craft was suddenly increased (e.g., due to an extra passenger latching on to a tow rope of a PWC) and the engine speed were to drop below the target engine speed, the operator would simply actuate the throttle further to again bring the engine speed up to the target speed. In this scenario, the ECU would simply recalculate the fuelling rate required to maintain the target speed in light of the increased load on the engine. Operation in speed limited mode would then resume in the manner as described above.

Apart from limiting the engine speed and/or maximum speed of the vehicle or craft, the present invention also has application as a "limp-home" mode of operation. That is, if the ECU detects an error or warning that further operation at high load could harm the engine, the ECU may act to limit the operation of the engine by restricting the maximum engine speed whilst still enabling the rider to "limp-home". The present invention could be used in such circumstances to limit further damage to the engine through any impatience of the rider.

The operation of an engine according to the method of the present invention will now be described with reference to FIG. 2. In Section A, the engine operates normally in that the fuelling rate demanded by the operator is equal to the fuelling rate delivered to the engine. This relates to non-speed limited operation and hence the engine speed demanded by the operator does not exceed the predetermined target speed of 4650 rpm as shown by P. It can be seen that as the throttle angle (represented by trace 50) increases so as to increase the engine speed (represented by trace 56) that the FPC demand (represented by trace 52) increases, and the FPC delivered or total FPC (represented by trace 54) also increases to match the operator demand. In this way, the fuelling level to the engine is increased in response to the increased throttle opening by the operator and hence increases the engine speed. It can be seen that the engine operates normally through Section A and that the engine increases in speed until the target speed of 4650 rpm is reached. That is, wide open throttle (WOT) fuelling levels could be achieved during an acceleration through Section A so long as the engine speed does not exceed the target engine speed. Once the target speed has been reached, the ECU detects this and reverts to a speed limited mode of operation.

As shown in Section B, the engine speed 56 does not (effectively) exceed the target speed P. It can be seen that the rider has continued to increase the throttle position 50 in an attempt to increase the engine speed 56. As the throttle position 50 has increased, so to has the FPC demand 52 which is proportional to the engine speed demanded by the operator. However, the speed controller has calculated the error between the demanded and the target engine speeds and has determined the fuel reduction level necessary to maintain the engine speed 56 at 4650 rpm. The total FPC delivered to the engine is therefore the FPC demand value 52 less the reduction level 60 calculated by the Pi controller. As shown, the total FPC delivered 54 in Section B remains relatively constant, and hence in an alternative embodiment, a set value could be used in place of a calculated value during speed limited operation. The shaded section 58 between the FPC demand trace 52, and the total FPC delivered trace 54 shows the reduction in the fuelling rate necessary to maintain the engine speed at 4650 rpm for varying degrees of throttle opening. Hence it can be seen that the speed or fuelling controller only ever operates to reduce the FPC demand value.

After the throttle position is relaxed to a level which would normally reduce the engine speed to a point below the target speed P, then as seen in Section C, the engine again resumes normal operation, and the engine speed 56 decreases. It is to be noted that the engine speed has not decreased the instant the throttle position 50 is reduced (as shown in Section B), as the throttle is still in a position which would result in an engine speed above the target speed P. That is, the degree of throttle opening is resulting in a demand for more fuel than is required to maintain the target engine speed. However, as seen in Section C, once the throttle position 50 drops below a level that would result in the target speed P, the FPC demand 52 again equals the FPC delivered 54, and the engine returns to a normal, non-speed limited mode of operation.

In one particular embodiment of the method according to the present invention, different fuelling or speed entry ramps may be implemented in order to smooth the transition into the speed limited mode of operation. For example, if the rate of change of the engine speed is very high, in certain engine applications, there is some chance that the engine speed may momentarily overshoot the target engine speed. This may result from the inherent mechanical and processing lags that exist in a particular fuel system. Accordingly, target speed entry ramps may be implemented such that the engine acceleration or rate of change of engine speed determines how long it takes to enter speed limited operation.

In one possible scenario, when the engine speed enters a predetermined engine speed band beneath the target speed setting, the ECU determines the rate of change of engine speed and on this basis determines a suitable speed gradient which may be implemented should the engine speed continue increasing to toward the target speed. A predetermined number of speed entry ramps may be implemented with the application of a particular entry ramp being dependent upon the determined rate of change of engine speed. Alternatively, the entry ramp used may be determined as a function of the rate of change of engine speed and hence be different for each transition into the speed limited mode. Typically, the greater the rate of change of engine speed, the more quickly a suitable speed entry ramp will be implemented to enable a smooth transition to the target speed for speed limited operation.

Above the target speed P, the ECU is able to reduce the demanded fuelling level so that reduced power is produced by the engine and the target speed P is maintained. However, whilst this does effectively limit the speed of the engine, bulk air flow into the combustion chamber is not affected by the reduced fuelling levels and remains under the control of the throttle with different degrees of throttle opening producing different levels of air flow to the engine. Hence, in Section B (during speed limited operation) of FIG. 2, even though the FPC delivered 54 and the engine speed 56 are held constant for a given load, the degree of throttle opening 50 which is still being controlled by the operator may vary considerably. As a consequence, different air-fuel ratios may result in the engine combustion chamber(s) which may effect the engine output torque and combustion stability. In the system described in FIG. 2, the overall result, particularly in the case of wide open throttle operation, is enleanment of the air-fuel ratio of the combustion mixture in the combustion chamber. This enleanment can result in lean misfire and the potential overheating of the engine, particularly at high operating loads.

As alluded to hereinbefore, under normal engine operation, the various combustion event timings such as SOF, EOF, SOA, EOA and IGN, are determined based on the demanded FPC level as derived from the throttle position and engine speed. During operation, the ECU determines the demanded FPC level from an FPC look-up map or table and then determines the necessary combustion event timings based on the particular FPC value. These event timings are normally calibrated to be the ideal angles for the current air-fuel ratio.

Figure 2:
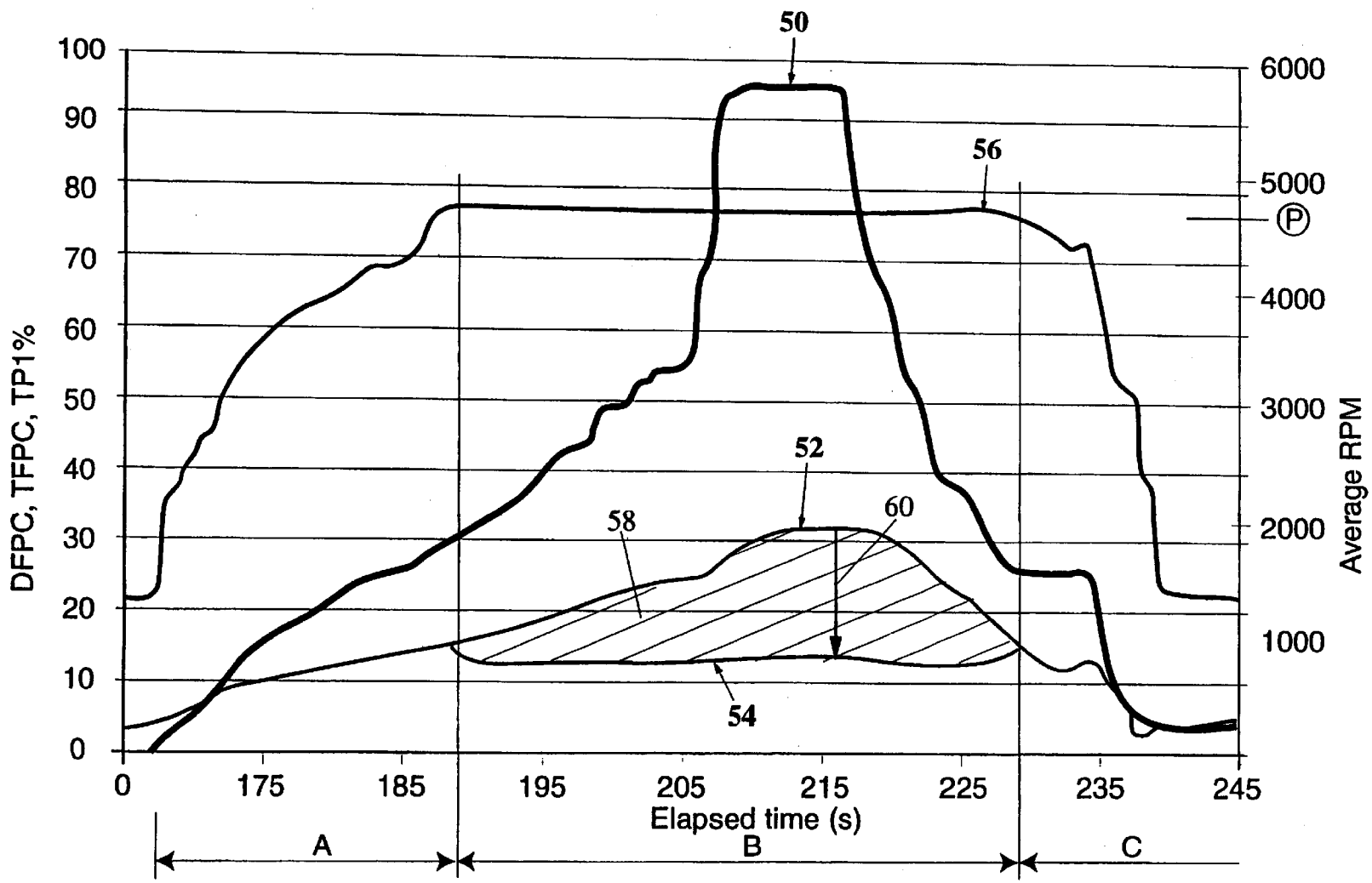
FIG. 2 shows a plot of various engine parameters for the present invention.

However, as can be seen from Section B in FIG. 2, the total FPC delivered to the engine can vary considerably from the FPC demanded by the operator. This can result in certain combustion event timings not being scheduled at the ideal or optimum times for the most efficient running of the engine. That is, during normal engine operation, based on the position of the throttle, the ECU typically determines that a certain fuelling level is required and determines, ideally from separate look-up tables, when the various events are to occur. However, if the speed controller has been enabled because the target engine speed has been reached, then the actual fuel supplied to the engine does not equal the fuel level for which the combustion events were calibrated, and in most cases the fuel/air mixture will be leaner. This is particularly the case where the operator has continued to open the throttle once the target engine speed has been attained. Had the separate look-up tables been calibrated for efficient engine management throughout Section B of FIG. 2, then the engine would not run at optimum efficiency or give desired response to the driver throughout Sections A and C.

Ideally, this may be resolved by having the ECU use a modified or second set of look-up tables when the engine is operating in speed limited mode. This second set of tables can then be calibrated to provide optimum efficiency for the prevailing air-fuel ratio within the engine cylinder. Hence combustion stability can be maintained and the engine output torque can be enhanced. The second set of tables may also or alternatively be calibrated so as to enable a certain level of engine-out emissions to be achieved.

Referring again to FIG. 2, during operation within Section A, the ECU initially determines an FPC demand value on the basis of the prevailing throttle position and engine speed. On the basis of this FPC demand value and the engine speed, appropriate settings for SOF, EOF, SOA, EOA and IGN are then determined from separate look-up tables. These event timings then control the fuel delivery and combustion events of the engine. This is also reflected in FIG. 1 wherein, once it has been determined that the target speed P has not been exceeded by the demanded speed (step 16), the normal event timing look-up maps are used at step 22.

However, during speed limited operation throughout Section B, the ECU refers to a modified or second set of look-up tables for each of the necessary combustion event timings. The values within these look-up tables are typically calibrated to account for the fact that the total FPC delivered to the engine will be different to the FPC demand value calculated in the FPC demand look-up table. These modified event timings will hence ensure that combustion stability, engine output torque and/or certain emissions benefits are maintained at a satisfactory level. This is reflected in FIG. 1 at step 24 where, once it has been determined that the engine is operating in a speed limited mode at step 18, the modified look-up maps are adapted for use by the ECU. Modified look-up tables may of course also be provided for other specific event timings, whether or not they are derived from the set of SOF, EOF, SOA, EOA and IGN.

When the engine speed again falls below the target speed P, the ECU will revert back to using the first set of look-up tables.

Such a modified or second set of look-up tables may also be of benefit when the ECU alters the normal operation of the engine, for example, when some combustion events may be skipped so as to limit the speed of the engine.

As alluded to hereinbefore, during normal engine operation, the specific lookup tables for SOF, EOF, SOA, EOA and IGN would typically have total FPC (which in this case would essentially be equal to the demand FPC) and engine speed as their ordinates. In contrast, where the air-fuel ratio would otherwise vary from the ideal during speed limited operation, the ordinates for the revised look-up tables may instead be total FPC (which in this case would not be equal to the demand FPC) and throttle position. In this way, the degree of throttle opening determined by the operator during speed limited operation can be taken into account and used to determine which event timings would provide for more beneficial engine operation. Furthermore, engine speed, which is effectively fixed at the target speed during speed limited operation, is replaced as an ordinate by a parameter which is directly indicative of the level if air flow to the engine and hence a primary influence on the air-fuel ratio attained within the combustion chamber(s). Accordingly, in an alternative arrangement, the modified look-up tables could equally have total FPC and air flow as their ordinates. This latter alternative may in fact offer some advantages in certain engine applications in regard attitude compensation. Hence, irrespective of which alternative may be adopted, the operator is again not "removed from the loop" during speed limited operation as would typically be the case with most existing speed limiting systems.

Under some circumstances, as the demanded engine speed reaches the target speed and the ECU switches from normal operation to speed limited operation, there may be a sudden change or jump in the various combustion event timings mentioned hereinabove. That is, it may be possible that the transition from normal operation to speed limited operation could result in large changes to the timings of certain specific combustion events. These relatively large changes may, in some circumstances, result in the engine not running smoothly and could result in engine misfire.

In order to avoid this transition jump, the ECU could be configured to consult the modified or second look-up tables shortly before the target speed is reached. The modified look-up tables themselves could then be arranged and calibrated to provide appropriate settings for the various event timings in the region just prior to the target speed. Hence, by consulting the second look-up tables just prior to the target speed being reached, the transition from normal operation to speed limited operation could be made smoother, and the timings of the various combustion events determined having regard to the imminent change. That is, the second set of look-up tables may be calibrated to allow for a smoother change from one set of timings to the second set of timings required during speed limited operation.

In a further alternative, provisions may be made to the engine speed control method to alleviate any unnecessarily high levels of processing by the speed controller that may result in certain inaccuracies. For example, during speed limited operation where the operator may be varying the throttle position (even though no increase in engine speed will result), the speed or fuelling controller is made to continually calculate the level of fuel that is required to be subtracted from the demanded FPC value in order to maintain the engine speed at the predetermined level. If the actuation of the throttle under such circumstances was to become excessively frequent, the speed controller would be caused to carry out very many calculations in order to constantly recalculate the demanded FPC and adjust the amount of fuel to be subtracted therefrom in order to maintain the same delivered FPC quantity. Where the variations to the demanded FPC are relatively large over a short period of time, and due to the inherent mechanical and processing lags which typically exist in the fuel system, a situation may arise wherein some instability may creep into the operation of the engine. In order to avoid this situation, a certain level of dampening may be applied to the change in throttle position effected by the operator so as to "smooth" or filter the input from the rider. In this way, any risk of the controller becoming less stable is reduced. That is, the controller would be able to perform all the necessary fuelling corrections and event timing updates without any inaccuracies or instability creeping into the fuel delivery and combustion processes.

In one preferred embodiment, the ability for the engine to operate in the speed limited mode may be enabled by use of a "smart key" or "smart card" normally required to start the engine. That is, the smart key may be configured so as to interact with the engine ECU such that the speed limited mode will be enabled once the demanded engine speed exceeds a predetermined set point speed. In this way, the provision of a different key to an experienced rider will ensure that the engine is prevented from reaching its top speed. In a PWC application for example, such a feature could be incorporated into a "programmable lanyard" which interacts with the ECU to enable engine operation. Other identification means which determine whether a speed limited mode should be invoked above a certain engine or vehicle speed may also be adapted for use with the method of the present invention. For example, thumbprint recognition means may be used to distinguish between inexperienced operators or children and regular users of a craft or vehicle.

Alternatively, such a speed limited mode of operation may be optionally selected via a switch or button on the dash or instrument panel of the particular vehicle or craft. In this way, the operator could be given the choice of when they desire to invoke speed limited operation should the engine speed exceed the predetermined speed. This may be particularly useful where the operator may wish to comply with, for example, a legislated speed limit that has been set down for a particular area or waterway. Further, in an alternative embodiment, the predetermined speed may be rendered variable by the presence of a further dial or switch which enables the operator to select the speed at which further throttle actuation or opening will have no effect.

As alluded to hereinbefore, the method of the present invention may be adapted to limit the road or water speed of a particular craft or vehicle. The method may hence have particular application to, for example, motorcycles or scooters where there is a need to restrict the top speed of the vehicle. In this regard, application of the present invention will enable performance to be maintained right up until the predetermined speed is attained. This may be a more desirable system in contrast to others which may require a gradual progression or transition into the governed speed. This may further result in emissions benefits due to the different mode of operation of the present engine speed control method.

Furthermore, whilst the concept of using a modified set of look-up maps has in the main been described with respect to maintaining satisfactory engine operation during a speed limited mode, such a feature may be equally applicable to any engine control system which is tolerant or susceptible to a wide variation in air-fuel ratio for a given speed.

The method of the present invention is not restricted for use with engine applications that have 100% mechanical throttle control. Where the operator is able to effect some level of control over the engine speed and/or the air-fuel ratio within the engine combustion chamber(s), a suitable variant of the present invention may be adapted to function in a manner similar to that described hereinbefore. Equally, whilst the method of the present invention has applicability to and has in part been discussed in respect of a fuel-led control system, it may also be suitably implemented where an air-led control system is preferentially used.

The method as described has applicability across a wide range of engine applications including both two and four stroke engines whether direct injected or not. The method is particularly applicable to lean burn direct injected engines. Further, whilst in the main discussed in relation to dual fluid fuel injection systems, the invention is equally applicable to single fluid fuel injection systems.

The method according to the present invention could be used in conjunction with a suitable overspeed control strategy, one example of which is disclosed in the Applicant's co-pending PCT patent application No. PCT/AU00/00650, the contents of which are included herein by reference. Such a combination may be particularly applicable to engines such as those fitted to PWCs used for wave-jumping where the load on the engine may suddenly vary by quite a large amount. In such a scenario, the predetermined target speed could be set at any convenient point below the engine overspeed limit at which the ECU may cut combustion events, to prevent over-revving of the engine. It may also be possible for the method of the present invention itself to be implemented as one form of overspeed control system.

The description of the invention made above is not intended to be limiting of the invention and other variations may be made by those skilled in the art without departing from the scope of the invention.

What is claimed is:

1. A method of controlling the engine speed of a spark-ignited internal combustion engine, the method including the steps of determining the engine speed demanded by an operator of the engine and comparing this demanded engine speed with a predetermined engine speed limit, wherein if the demanded engine speed exceeds the predetermined engine speed limit, the fuelling rate demanded by the operator is only reduced in order to control the engine speed to the predetermined engine speed limit, and wherein air flow to said spark-ignited engine is directly controlled by the operator of the engine.

2. A method according to claim 1, wherein if the demanded engine speed is less than the predetermined engine speed limit, then no change is made to the normal operation of the engine.

3. A method according to claim 1, wherein when the demanded engine speed exceeds the predetermined engine speed limit, the actual fuelling rate to the engine never exceeds that corresponding to the predetermined engine speed limit.

4. A method according to claim 1, wherein a controller implemented to govern the engine fuelling rate to control the engine speed to the predetermined engine speed limit operates exclusively in a uni-directional manner to only ever reduce the demanded fuelling rate.

5. A method according to claim 1, wherein the level of reduction of the demanded engine fueling rate is a function of the demanded engine speed.

6. A method according to claim 5, wherein the actual amount of fuel to be delivered to the engine is determined by considering the difference between the demanded engine speed and the engine speed limit and reducing the demanded fuelling level accordingly.

7. A method according to claim 1, wherein the amount of reduction to the demanded fuelling rate is directly controlled by the operator, the actuation of a throttle means by the operator serving as a input which assists determination of the reduction to the demanded fuelling rate when the demanded engine speed is about the predetermined engine speed limit.

8. A method according to claim 7, wherein, once the predetermined engine speed limit has been exceeded, the amount of reduction required to the demanded fuelling rate increases as the degree of opening of the throttle means increases.

9. A method according to claim 7, wherein a certain level of dampening is applied to the change in position of the throttle means effected by the operator.

10. A method according to claim 1, wherein a maximum or set amount of fuel is delivered once the predetermined engine speed limit has been reached, the fuelling rate returning to normal levels when the demanded engine speed subsequently falls below the predetermined engine speed limit.

11. A method according to claim 1, wherein control over the engine speed is effected by a fuel-led control system.

12. A method according to claim 1, wherein the engine speed is controlled to the predetermined engine speed limit in order to provide a limp-home mode of engine operation.

13. A method according to claim 1, wherein speed entry ramps are implemented to facilitate a smooth transition to the predetermined engine speed, the entry ramps being determined as a function of the rate of change of the engine speed prior to attainment of the predetermined engine speed limit.

14. A method according to claim 1, wherein the ability for the engine to be controlled to the predetermined engine speed limit is enabled by the use of programmable key or card.

15. An ECU according to claim 1, wherein control over the engine speed is effected by a fuel-led control system.

16. A method of controlling the speed of a vehicle, in which air flow to the engine is directly controlled by an operator of the vehicle, the method including the steps of determining the vehicle speed demanded by the operator of the vehicle and comparing this demanded vehicle speed with a predetermined vehicle speed limit, wherein if the demanded vehicle speed exceeds the predetermined vehicle speed limit, the fuelling rate demanded by the operator is only reduced in order to control the vehicle speed to the predetermined vehicle speed limit.

17. A method of controlling the engine speed of a spark-ignited internal combustion engine in which air flow to the spark ignited engine is directly controlled by an operator of the engine including operating the engine in a speed limited mode in response to a demanded engine speed exceeding a predetermined engine speed limit, wherein modified event timings are used during said speed limited mode, said modified event timings varying from the normal event timings which would otherwise be used at the predetermined engine speed.

18. A method according to claim 17, including maintaining the actual engine fuelling rate at a level that is necessary to achieve the predetermined engine speed when operating in said speed limited mode.

19. A method according to claim 17, including using said modified event timings when the air-fuel ratio to the engine varies from the typical air-fuel ratio at the predetermined engine speed.

20. A method according to claim 17, wherein the engine includes a dual-fluid fuel injection system, and modified event timings are used for at least one of start of fuel metering (SOF), end of fuel metering (EOF), start of air injection (SOA), end of air injection (EOA) or ignition (IGN) when the engine is operating in said speed limited mode.

21. A method according to claim 17, wherein when the engine is operating outside of the speed limited mode, the normal event timings are selected as a function of total fuel per cycle and engine speed.

22. A method according to claim 17, wherein when the engine is operating in said speed limited mode, the modified event timings are determined as a function of total fuel per cycle and throttle position.

23. A method according to claim 17, wherein when the engine is operating in said speed limited mode, the modified event timings are determined as a function of total fuel per cycle and air flow.

24. A method according to claim 23, wherein total fuel per cycle, engine speed, throttle position and air flow are ordinates for respective electronic look-up maps which are stored in an electronic unit which manages the operation of the engine.

25. A method according to claim 17, wherein so as to avoid an undesirable transition from the normal event timings to the modified event timings, the modified event timings are consulted just prior to attainment of the predetermined engine speed limit.

26. A method according to claim 17, wherein control over the engine speed is effected by a fuel-led control system.

27. An ECU adapted to control the engine speed of a spark-ignited internal combustion engine, including the steps of determining the engine speed demanded by an operator of the engine and comparing this demanded engine speed with a predetermined engine speed limit, wherein if the demanded engine speed exceeds the predetermined engine speed limit, the fuelling rate demanded by the operator is only reduced in order to control the engine speed to the predetermined engine speed limit and wherein air flow to said spark-ignited engine is directly controlled by the operator of the engine.

28. An ECU according to claim 27, wherein when the demanded engine speed exceeds the predetermined engine speed limit, the actual fuelling rate to the engine never exceeds that corresponding to the predetermined engine speed limit.

29. An ECU according to claim 27, wherein a controller implemented to govern the engine fuelling rate to control the engine speed to the predetermined engine speed limit operates exclusively in a uni-directional manner to only ever reduce the demanded fuelling rate.

30. An ECU according to claim 27, wherein the level of reduction of the demanded engine fuelling rate is a function of the demanded engine speed.

31. An ECU according to claim 30, wherein the actual amount of fuel to be delivered to the engine is determined by considering the difference between the demanded engine speed and the engine speed limit and reducing he demanded fuelling level accordingly.

32. An ECU adapted to control the engine speed of a spark-ignited internal combustion engine in which air flow to the engine is directly controlled by an operator of the engine including operating the engine in a speed limited mode in response to a demanded engine speed exceeding a predetermined engine speed limit, wherein modified event timings are used during said speed limited mode, said modified event timings varying from the normal event timings which would otherwise be used at the predetermined engine speed.

33. An ECU according to claim 32, including maintaining the actual engine fuelling rate at a level that is necessary to achieve the predetermined engine speed when operating in said speed limited mode.

34. An ECU according to claim 33, wherein when the engine is operating in said speed limited mode, the modified event timings are determined as a function of total fuel per cycle and throttle position.

35. An ECU according to claim 32, including using said modified event timings when the air-fuel ratio to the engine varies from the typical air-fuel ratio at the predetermined engine speed.

36. An ECU according to claim 32, wherein the engine includes a dual-fluid fuel injection system, and modified even timings are used for at least one of start of fuel metering (SOF), end of fuel metering (EOF), start of air injection (SOA), end of air injection (EOA) or ignition (IGN) when the engine is operating in said speed limited mode.

37. An ECU according to claim 32, wherein when the engine is operating in said speed limited mode, the modified event timings are determined as a function of total fuel per cycle and air flow.

38. An ECU according to claim 37, wherein total fuel per cycle, engine speed, throttle position and air flow are ordinates for respective electronic look-up maps which are stored in an electronic unit which manages the operation of the engine.

39. An ECU according to claim 32, wherein control over the engine speed is effected by a fuel-led control system.

40. A method of controlling the engine speed of a spark-ignited internal combustion engine, wherein the air flow rate is directly controlled by the operator, the method including the steps of determining the engine speed demanded by an operator of the engine, and comparing this demanded engine speed with a predetermined engine speed limit, wherein if the demanded engine speed exceeds the predetermined engine speed limit then air flow to the engine to satisfy a fuelling rate demanded by the operator is only reduced in order to control the engine speed to the predetermined engine speed limit, the actuation of a throttle means by the operator serving as an input which assists determination of the reduction of the air flow when the demanded engine speed is above the predetermined engine speed limit.

* * * * *